US010865733B2

(12) United States Patent
Clark

(10) Patent No.: US 10,865,733 B2
(45) Date of Patent: Dec. 15, 2020

(54) MOTOR VEHICLE CYLINDER HEAD

(71) Applicant: Ford Global Technologies, LLC, Dearborn, MI (US)

(72) Inventor: Stephen Leonard Clark, Bedford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 11 days.

(21) Appl. No.: 15/961,459

(22) Filed: Apr. 24, 2018

(65) Prior Publication Data

US 2018/0334990 A1 Nov. 22, 2018

(30) Foreign Application Priority Data

May 22, 2017 (GB) ..... 1708143.1

(51) Int. Cl.

| | |
|---|---|
| ***F01P 3/02*** | (2006.01) |
| ***F02F 1/36*** | (2006.01) |
| ***F02F 1/24*** | (2006.01) |
| ***F02F 1/42*** | (2006.01) |
| ***F02F 1/40*** | (2006.01) |
| *F01N 13/10* | (2010.01) |

(52) U.S. Cl.

CPC *F02F 1/36* (2013.01); *F01P 3/02* (2013.01); *F02F 1/243* (2013.01); *F02F 1/40* (2013.01); *F02F 1/4264* (2013.01); *F01N 13/105* (2013.01); *F01P 2003/024* (2013.01); *F02F 2001/249* (2013.01); *F02F 2200/06* (2013.01)

(58) Field of Classification Search

CPC .. F02F 1/24; F02F 1/243; F02F 1/4264; F02F 1/36; F02F 2001/249; F02F 2003/024; F02F 2200/06; F01P 3/20; F01P 5/10; F01P 5/12; F01P 2007/146; F01N 13/105; B60K 11/02

USPC ..... 123/41.01, 41.02, 41.04, 41.09, 41.31, 123/41.34

See application file for complete search history.

(56) References Cited

U.S. PATENT DOCUMENTS 5,381,763 A * 1/1995 Niemchick ..... F02B 61/045 123/41.09
8,857,386 B2 * 10/2014 Kuhlbach ..... F02F 1/243 123/41.82 R (Continued)

FOREIGN PATENT DOCUMENTS

EP 1477645 A1 11/2004
JP H11182241 A 7/1999

(Continued)

OTHER PUBLICATIONS

Intellectual Property Office of the United Kingdom, Combined Search and Examination Report Issued in Application No. GB1708143.1, dated Nov. 9, 2017, South Wales, 7 pages.

*Primary Examiner* — John Kwon
*Assistant Examiner* — Johnny H Hoang
(74) *Attorney, Agent, or Firm* — Geoffrey Brumbaugh; McCoy Russell LLP

(57) ABSTRACT

A motor vehicle cylinder head is provided with a single flat planar surface in which are formed spaced apart integral inlet and outlet ports used for connecting respective coolant supply and returns to a coolant jacket defined within the cylinder head. The use of a common planar surface for the location of the inlet and outlet ports provides a more reliable sealing of the cylinder head to the respective coolant supply and returns.

19 Claims, 6 Drawing Sheets

(56) References Cited

U.S. PATENT DOCUMENTS

2005/0257756 A1* 11/2005 Endoh ..... F01P 3/02 123/41.79
2007/0056276 A1* 3/2007 Petutsching ..... F01N 3/046 60/321
2009/0126659 A1* 5/2009 Lester ..... F01N 3/046 123/41.72
2011/0083622 A1* 4/2011 Megel ..... F02F 1/242 123/41.72
2011/0083624 A1* 4/2011 Megel ..... F02F 1/242 123/41.82 R
2011/0296834 A1* 12/2011 Kuhlbach ..... F01P 7/165 60/605.3
2012/0090566 A1* 4/2012 Knollmayr ..... F02F 1/40 123/41.82 R
2012/0240883 A1 9/2012 McGiffin et al.
2012/0312257 A1* 12/2012 Beyer ..... F01P 11/0285 123/41.82 R
2013/0025560 A1* 1/2013 Thomas ..... F02F 1/24 123/193.5
2013/0192546 A1* 8/2013 Ruffing ..... F02F 1/40 123/41.76
2013/0291811 A1* 11/2013 Kuhlbach ..... F02F 1/243 123/41.72
2015/0053154 A1* 2/2015 Ganla ..... F02F 1/002 123/41.69
2017/0218880 A1* 8/2017 Hemink ..... F01N 13/105
2017/0276095 A1 9/2017 Beyer et al.
2017/0306831 A1* 10/2017 Craft ..... F01P 3/14
2018/0187625 A1* 7/2018 Hopf ..... F02F 1/42

FOREIGN PATENT DOCUMENTS

JP 2006161689 A 6/2006
JP 2010196518 A 9/2010
WO 2011000757 A1 1/2011

* cited by examiner

MOTOR VEHICLE CYLINDER HEAD

CROSS REFERENCE TO RELATED APPLICATION

This application claims priority to Great Britain Patent Application No. 1708143.1, filed May 22, 2017. The entire contents of the above-referenced application are hereby incorporated by reference in their entirety for all purposes.

BACKGROUND/SUMMARY

This disclosure relates to internal combustion engines and in particular to the cooling of a cylinder head of an internal combustion engine.

It is well known to provide a cylinder head of a combustion engine with a number of internal coolant passages to flow coolant around the cylinder head and which are often referred to as a coolant or water jacket.

It is often the case that the supply of coolant to or from the cylinder head requires the use of an external conduit that has to be sealed at opposite ends to the cylinder head. This can result in the conduit needing to be sealed on vertical plane at one end and a horizontal plane at an opposite end which is difficult to achieve.

In addition, the layout of the internal coolant passages is designed to provide optimum cooling with less priority regarding ease of manufacturing and, in particular, as to how cores used in the casting process to produce the internal coolant passages can be removed. This often results in the need for additional apertures in the cylinder head in order to permit the core material to be readily removed.

It is an object of this disclosure to provide a cylinder head in which the connection to internal coolant passages within the cylinder head is more easily made in a more reliable manner and which provides improved ease of manufacture.

According to a first aspect of the disclosure there is provided a cylinder head of an engine having a coolant jacket formed therein for circulating coolant through the cylinder head and a combined inlet and outlet connector formed as an integral part of the cylinder head for connecting the cylinder head to an external coolant system, the combined inlet and outlet connector comprising a flat planar surface defining in a spaced apart manner coolant inlet and outlet ports with the coolant inlet port being positioned vertically below the coolant outlet port wherein a lower surface of the cylinder head is formed by a flame plate of the coolant jacket and internal supply passages connected to the inlet port are positioned adjacent the flame plate so as to flow coolant over the flame plate.

The inlet port may be a cylindrical port formed in the flat planar surface and the outlet port may be a cylindrical port formed in the flat planar surface.

The coolant jacket may include a number of internal return passages for flowing coolant through the coolant jacket back to the outlet port.

The internal supply passages may be connected to the internal return passages so as to form a cooling circuit within the cylinder head.

The inlet port may be located near a lower face of the cylinder head and a first side of the cylinder head and the outlet port may be located near an upper surface of the cylinder head and the first side of the cylinder head and the cooling circuit of the cylinder head may flow coolant from the inlet port through the internal supply passages to a second opposite side of the cylinder head, upwardly and back across the cylinder head from the second side of the cylinder head though the internal return passages to the outlet port near the first side of the cylinder head.

The cooling circuit within the cylinder head may be a double-pass two-plane coolant circuit.

The cylinder head may have an exhaust gas manifold formed as an integral part thereof.

The flat planar surface may be produced by machining an outer face of the cylinder head.

The inlet port may be produced by a casting and finish machining process.

The outlet port may be produced by a casting and finish machining process.

According to a second aspect of the disclosure there is provided an engine having a cylinder block to which is sealingly secured a cylinder head constructed in accordance with said first aspect of the disclosure.

BRIEF DESCRIPTION OF THE FIGURES

The disclosure will now be described by way of example with reference to the accompanying drawings. The figures are drawn to scale, although other relative dimensions may be used, if desired.

With reference to FIGS. 1 to 3 there is shown an internal combustion engine 5 having a cylinder block 6 and a cylinder head 10.

DETAILED DESCRIPTION

Figure 1:
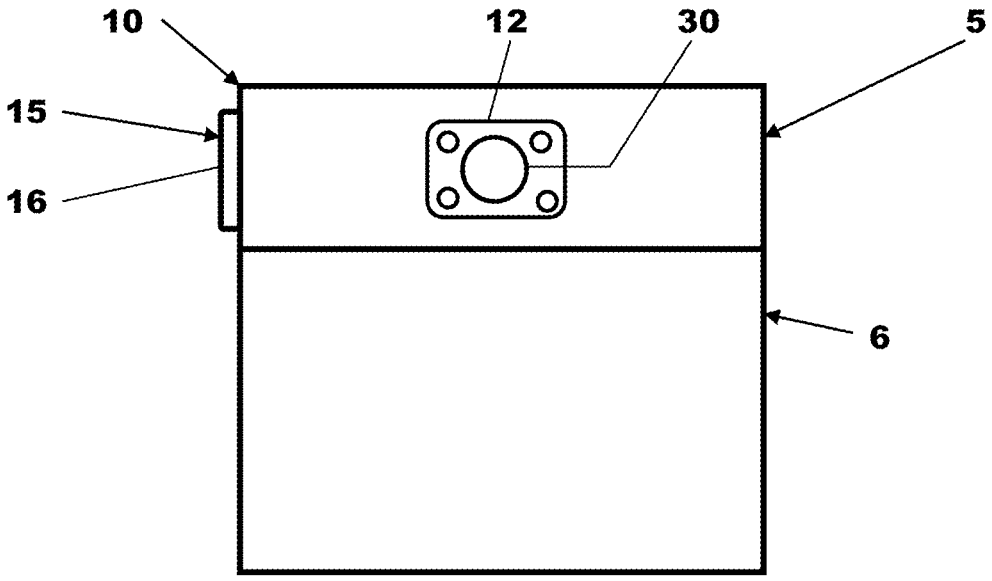
FIG. 1 is a schematic side view of an internal combustion engine having a cylinder head constructed in accordance with one embodiment of the disclosure.
Figure 2:
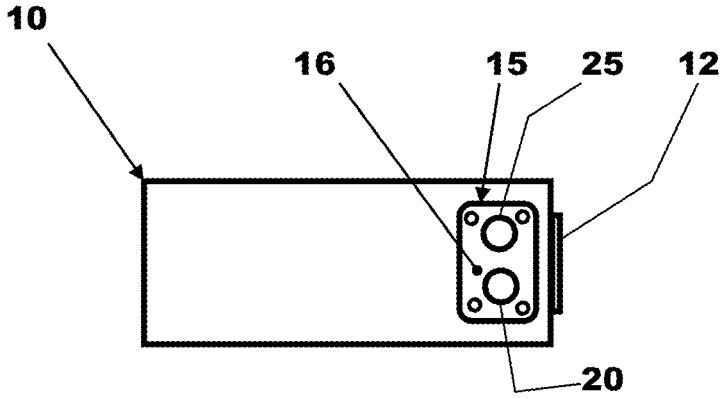
FIG. 2 is an end view of the cylinder head shown in FIG. 1 showing a combined inlet and outlet coolant connector.
Figure 3:
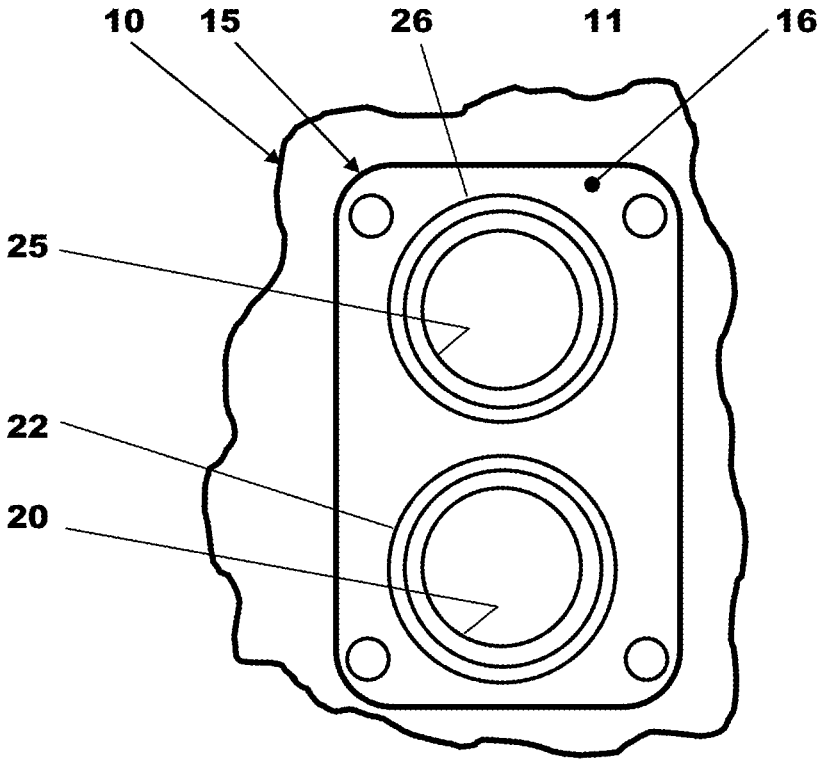
FIG. 3 is an enlarged view of the combined inlet and outlet coolant connector shown in FIG. 2.

The cylinder head 10 has an exhaust gas manifold formed as an integral part thereof and a lower face that in use is sealingly fastened to an upper face of the cylinder block 6 as is well known in the art. An outlet port 30 of the internal exhaust gas manifold is shown on a side face of the cylinder head 10 located in an exhaust system mount 12 machined on an outer face of the cylinder head 10. It will be appreciated that an exhaust system (not shown) is sealingly fastened to the exhaust system mount 12 on the cylinder head 10 in use to transfer exhaust gases away from the engine 5 to atmosphere.

The cylinder head 10 has a number of internal coolant passages formed therein (not shown) forming a coolant jacket that is used to flow coolant around the cylinder head 10 so as to cool the cylinder head 10.

The cylinder head 10 includes a combined inlet and outlet coolant connector 15 formed as an integral part of the cylinder head 10. The combined inlet and outlet coolant connector 15 comprises a flat planar surface 16 machined on an outer face of the cylinder head 10 defining an inlet port 20 and an outlet port 25 both of which are formed as integral parts of the cylinder head 10 by casting and then finish machining.

In the case of the example shown the inlet and outlet ports 20 and 25 are both cylindrical in shape and are positioned vertically one above the other with the outlet port 25 being positioned above the inlet port 20.

It will however be appreciated that the ports could be of a different shape and/or orientation in other embodiments.

As shown the inlet port 20 has a concentric O-ring groove 22 for accommodating an O-ring (not shown) and the outlet port 25 has a concentric O-ring groove 26 for accommodating an O-ring (not shown).

The arrangement of the inlet port 20 below the outlet port is advantageous in that the internal passage to which the inlet port 20 connects can then be positioned adjacent a lower coolant jacket flame plate which is a critical area that requires considerable cooling affect due to its proximity to the process of combustion. The flame plate forms a boundary between the cylinders of the engine 5 and the cylinder head 10.

The location of the combined inlet and outlet coolant connector 15 and the fact that the inlet and outlet ports 20 and 25 are of a relatively large diameter and can be aligned with coolant flow passages that extend for a significant distance along the cylinder head 10 and in some cases the entire length of the cylinder head 10 enables easier extraction of the core material used during the manufacturing casting process of the cylinder head 10.

It will be appreciated that manufacturing of the combined inlet and outlet coolant connector 15 is relatively straightforward because it only requires the machining of a flat planar surface 16 onto the cylinder head 10 in a desired location and the finish machining of the inlet and outlet ports 20 and 25 in the flat planar surface 16 and both of these processes are conventional in nature and can be performed in a consistent and precise manner.

In addition, the sealing of connectors to the cylinder head 10 can be made in a reliable manner due to the use of a flat planar surface that enables the efficient and reliable use of many alternative sealing arrangements such as, for example, an O-ring type of sealing arrangement, a gasket type of sealing arrangement using a flat strip of sealing material or non-permanent liquid sealant type of sealing arrangement.

With particular reference to FIGS. 4 to 9 there is shown a second embodiment of a cylinder head constructed in accordance with this disclosure.

As before, the cylinder head 110 has an exhaust gas manifold formed as an integral part thereof. The cylinder head 110 has an upper face 114 to which a camshaft carrier/cover is secured in use and a lower face 113 that in use is sealingly fastened to an upper face of a cylinder block of an engine.

An outlet port 130 of the internal exhaust gas manifold is shown on a side face of the cylinder head 110 located in an exhaust system mount 112. It will be appreciated that an exhaust system (not shown) is sealingly fastened to the exhaust system mount 112 on the cylinder head 110 in use to transfer exhaust gases away from an engine of which the cylinder head 110 forms a part to atmosphere. In some embodiments, an exhaust system mount may comprise a flat planar surface forming part of an exterior surface of a cylinder head.

Figure 9:
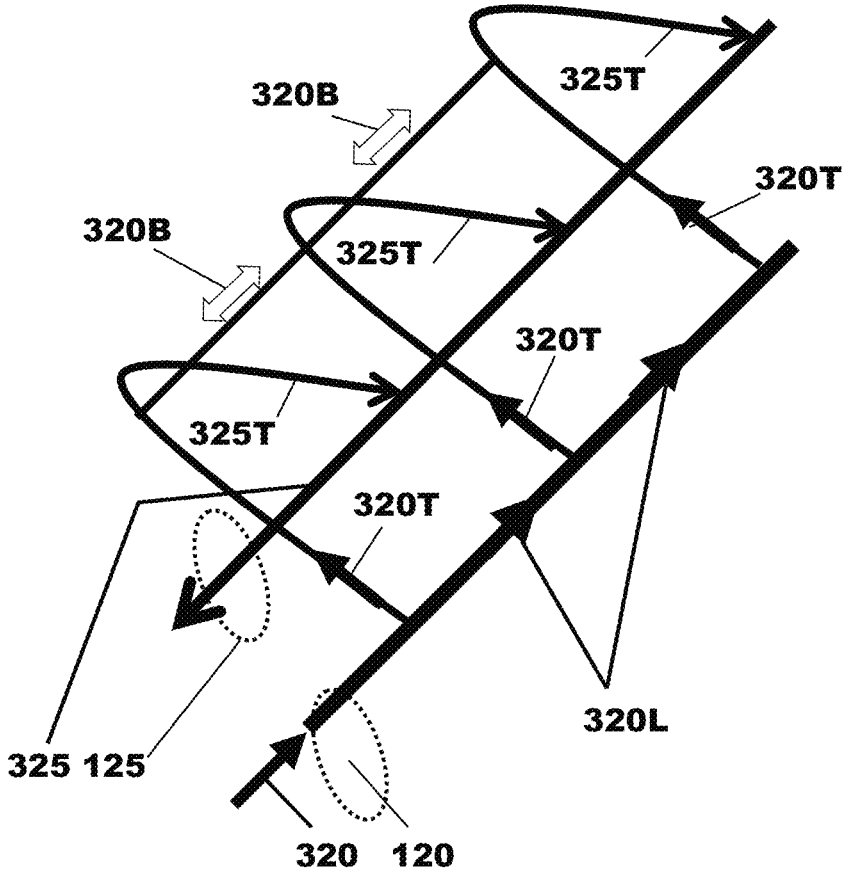
FIG. 9 is a diagrammatic representation of the flow of coolant through the cylinder head shown in FIGS. 4 to 6 from an inlet port to an outlet port of the combined inlet and outlet coolant connector.

The cylinder head 110 has a number of internal coolant passages formed therein shown diagrammatically in FIG. 9 to flow coolant around the cylinder head 110 so as to transfer heat away from the cylinder head 110 to an external coolant system (See FIG. 10) having one or more heat exchangers to cool the coolant that flows therethrough.

Figure 10:
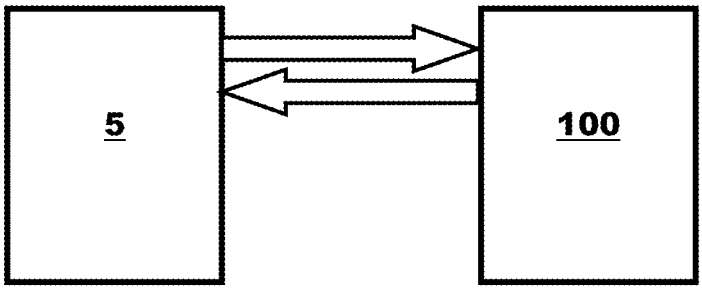
FIG. 10 is a schematic diagram of an engine system having an engine and a cooling system for the engine shown in FIG. 1.

In FIG. 10 an external coolant system 100 is shown connected to the engine 5. It will be appreciated that there are many variations in the mode of connection of a coolant system to an engine. For example, in some arrangements coolant flows to a cylinder head and returns directly from the cylinder head to the coolant system and, in other embodiments, coolant is supplied to the cylinder head and is returned to the coolant system via a cylinder block of the engine. It will be appreciated that a cylinder head constructed in accordance with this disclosure is not limited to a specific arrangement of connection between the cylinder head and the coolant system.

The cylinder head 110 includes a combined inlet and outlet coolant connector 115 formed as an integral part of the cylinder head 110. The combined inlet and outlet coolant connector 115 comprises a flat planar surface 116 formed by machining an outer surface of the cylinder head 110 that defines an inlet port 120 and an outlet port 125.

The inlet port 120 and the outlet port 125 are both formed as integral parts of the cylinder head 110 by a casting and finish machining process.

Figure 4:
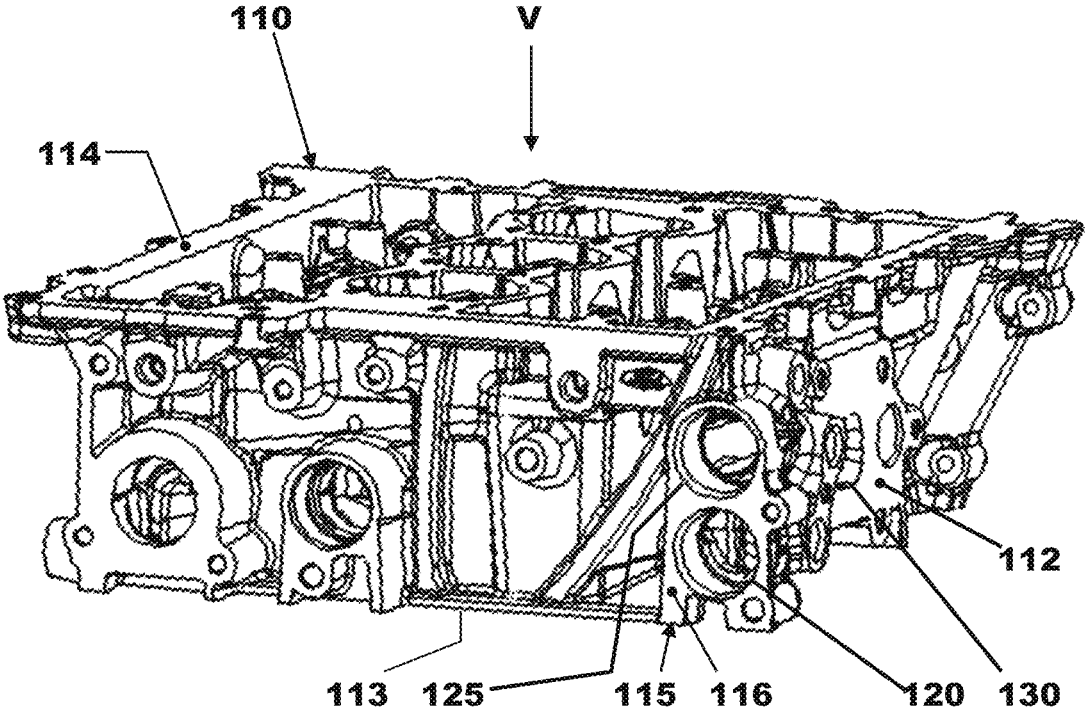
FIG. 4 is a pictorial view of a second embodiment of a cylinder head in accordance with the disclosure showing a combined inlet and outlet coolant connector.
Figure 5:
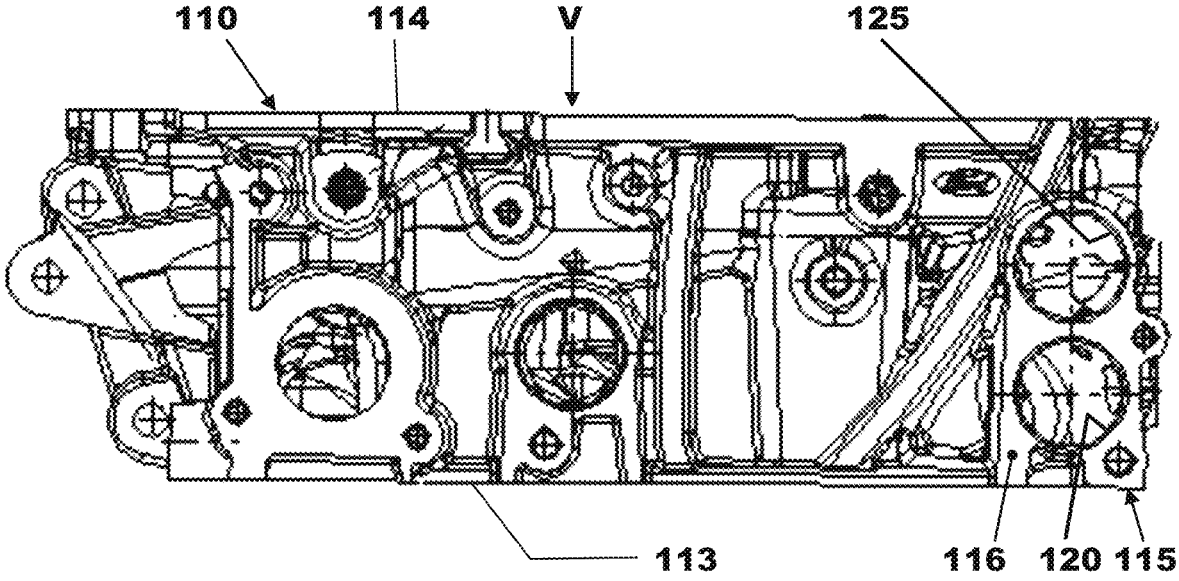
FIG. 5 is a rear end view of the cylinder head shown in FIG. 4.
Figure 6:
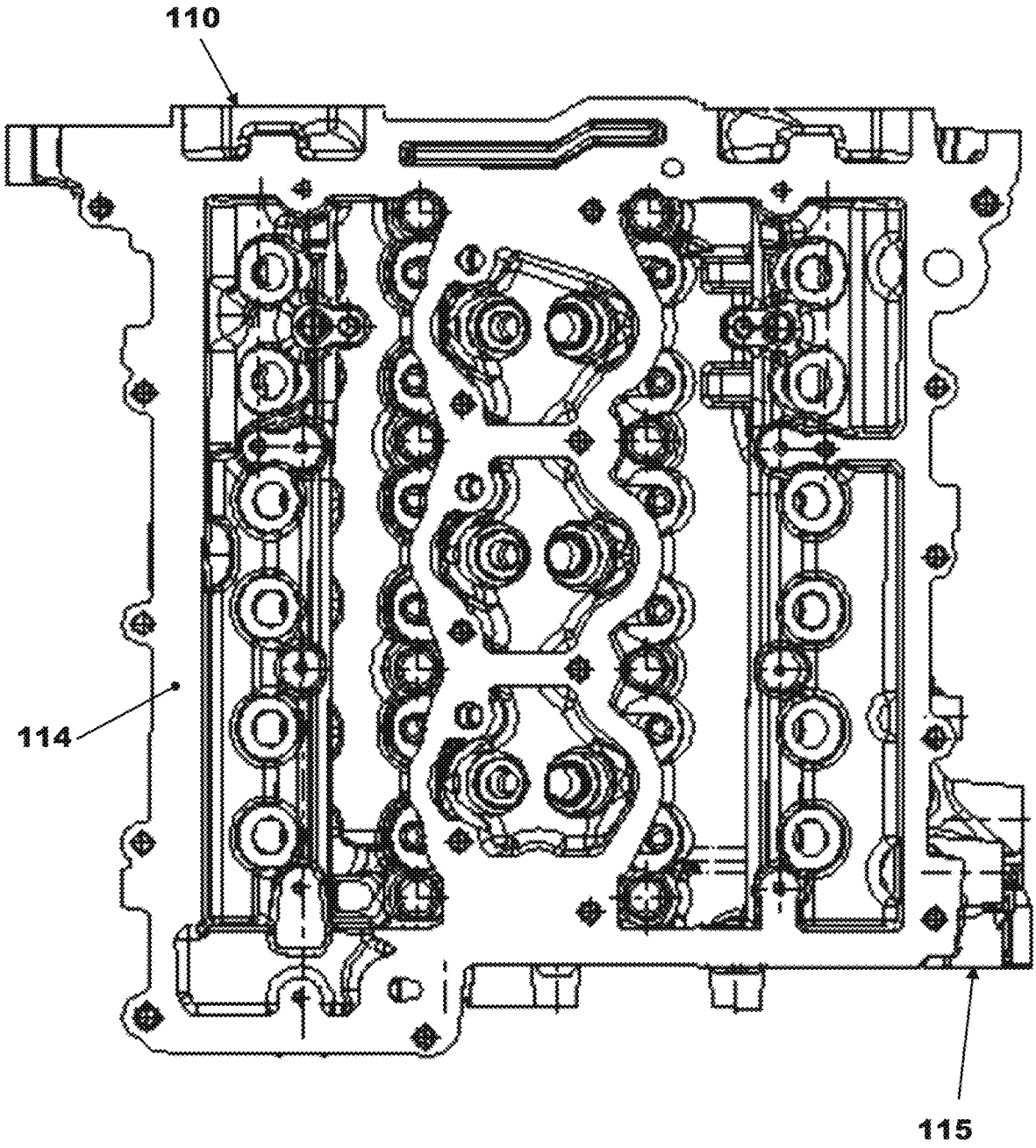
FIG. 6 is a plan view of the cylinder head in the direction of the arrow V on FIGS. 4 and 5.

In the case of the example shown in FIGS. 4 to 6 the inlet and outlet ports 120 and 125 are both cylindrical in shape and are positioned vertically one above the other with the outlet port 125 being positioned above the inlet port 120.

It will however be appreciated that the inlet and outlet ports could be of a different shape and/or orientation in other embodiments.

The arrangement of the inlet port 120 below the outlet port is advantageous in that the internal passages (320B, 320L, 320T on FIG. 9) to which the inlet port 120 connects can then be positioned adjacent a lower coolant jacket flame plate which is a critical area that requires considerable cooling affect due to its proximity to the process of combustion. The lower flame plate forms a boundary between the cylinders of the engine to which the cylinder head 110 is attached via the lower face 113 and the rest of the cylinder head 110. It will be appreciated that the lower face 113 includes a peripheral part for sealingly attaching the cylinder head 110 to a cylinder block and an interior part defining the flame plate.

Figure 7:
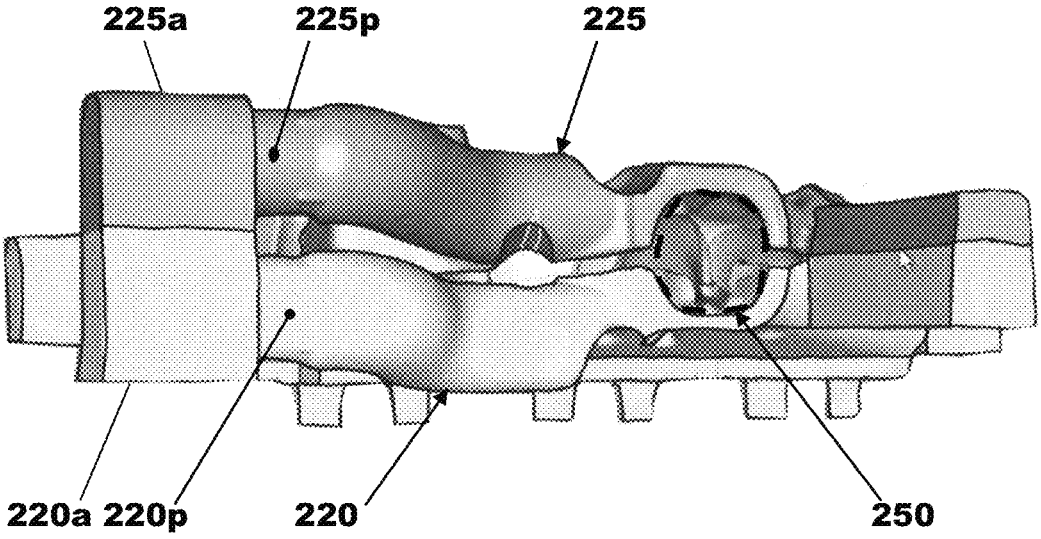
FIG. 7 is a side view showing inlet and outlet cores used to manufacture internal cooling passages of the cylinder head shown in FIGS. 4 to 6.
Figure 8:
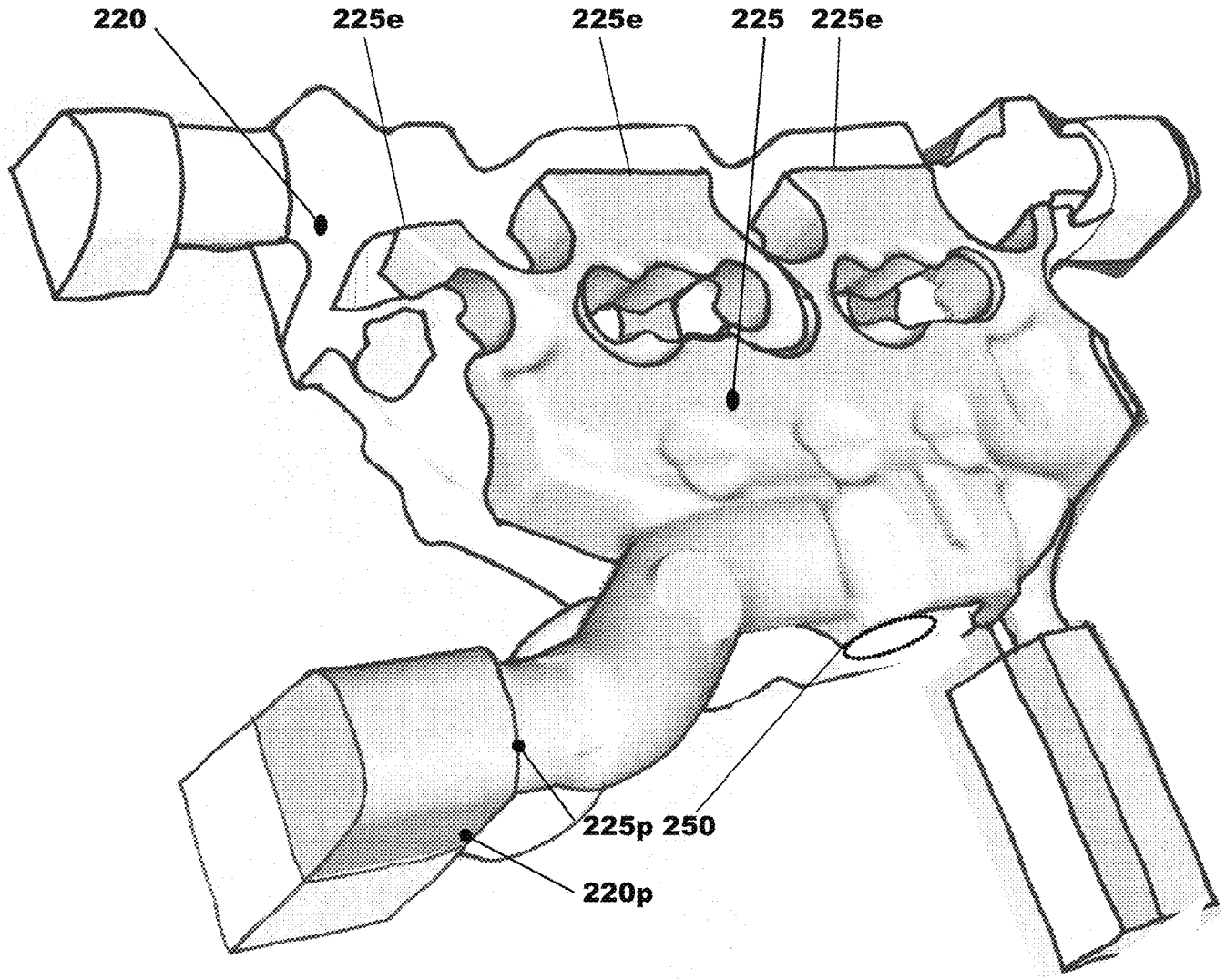
FIG. 8 is a pictorial view from above of the cores shown in FIG. 7.

The location of the combined inlet and outlet coolant connector 115 and the fact that the inlet and outlet ports 120 and 125 are of a relatively large diameter and can be aligned with coolant flow passages that extend for a significant distance along the length of the cylinder head 110 enables easier extraction of the core material used during the casting of the cylinder head 110. Referring now to FIGS. 7 and 8 there are shown inlet and outlet cores used to manufacture the internal cooling passages that are connected to the inlet and outlet ports 120 and 125 and the ports 120, 125.

A lower inlet core 220 is used to define the internal coolant flow passages and the inlet port 120 and an upper outlet core 225 is used to define the internal coolant passages and the outlet port 125.

The outlet core 225 rests upon the inlet core 220 along a boundary edge 225*e* of the outlet core 225 forming an interconnection or junction between the inlet and outlet coolant flow passages of the cylinder head 110.

The portion of the lower inlet core 220 that defines the un-machined inlet port 120 is indicated by the arrow 220*p* on FIGS. 7 and 8 and the portion of the upper inlet core 225 that defines the un-machined outlet port 125 is indicated by the arrow 225*p* on FIGS. 7 and 8.

A core (not shown) forming the internal exhaust gas manifold is positioned between the upper and lower cores 225 and 220 and has a portion extending out through an aperture 250 shown by a dotted line on FIGS. 7 and 8. The proximity of cooling passages in the cylinder head 110 to the location of the exhaust gas exit path improves cooling in this area of the cylinder head 110.

Respective end extensions 220*a*, 225*a* (see FIG. 7) of the inlet and outlet cores 220 and 225 form a spacer that reduces the need for additional core supports to be used. After casting of the cylinder head 110 the end portions 220*a*, 225*a* are removed and a machining process is used to produce the flat planar surface 116 on the cylinder head 110 in a desired location. The inlet and outlet ports 120 and 125 are then subsequently machined in the flat planar surface 116 by boring or drilling. Both of these machining processes are conventional in nature and can be performed economically in a consistent and precise manner.

One of the advantages of the inlet and outlet port arrangement shown in FIGS. 4 to 6 is that the internal coolant passage in the cylinder head 110 to which the inlet port 120 is connected is aligned with the inlet port 120 and the internal coolant passage in the cylinder head 110 to which the outlet port 125 is connected is aligned with the outlet port 125.

This aligned arrangement has two positive effects. Firstly, it improves the flow of coolant into and out of the cylinder head 110 because there are no sharp corners to be flowed around; and secondly, it allows the material forming the inlet and outlet cores 220 and 225 to be more easily removed from the cast cylinder head 110 after casting of the cylinder head 110.

In addition to the manufacturing advantages referred to previously, the sealing of connectors to and from the cylinder head 110 can be made in a reliable manner due to the use of a flat planar surface that enables the use of many types of sealing arrangement. For example, it enables the effective use of a gasket type of sealing arrangement using a flat strip of sealing material, a non-permanent liquid sealant type of sealing arrangement or an O-ring type of sealing arrangement.

By positioning the inlet and outlet ports 120 and 125 in close proximity and on a common flat planar surface 116 a single housing can be sealingly fastened to the cylinder head 110 to connect both an inlet to the cylinder head 110 and an outlet from the cylinder head 110 or separate housings can be sealingly fastened thereto. For example and without limitation a water pump housing could be mounted directly upon the flat planar surface 116 if required to supply coolant to the cylinder head 110 or a thermostat housing could be mounted directly upon the flat planar surface 116 if required to control the flow of coolant into or out of the cylinder head 110.

With particular reference to FIG. 9 there is shown in a diagrammatic manner the flow of coolant through the cylinder head 110.

Coolant enters the cylinder head 110 through the inlet port 120 positioned in this case on an end of the cylinder head 110 near to a first side of the cylinder block 110 as indicated by the arrow 320. The coolant flows from the inlet port 120 into a longitudinally extending lower coolant supply path 320L that supplies coolant to a number of transfer passages 320T that extend from the first side of the cylinder head 110 towards an opposite second side of the cylinder head 110. The longitudinally extending lower coolant supply path 320L and the transfer passages 320T are both located adjacent to the flame plate of the cylinder head 110.

The transfer flow paths 320T are interconnected near the second side of the cylinder head 110 and so coolant can flow therebetween as indicated by the double headed arrows 320B.

The line 325*e* on FIG. 9 corresponds to the position where the lower inlet core 220 connects to the edge 225*e* of the upper outlet core 225 on FIG. 8.

From the position 325*e* the coolant flows upwardly and back toward the first side of the cylinder block 110 via transfer flow paths 325T formed during manufacture by the upper outlet core 225 before exiting the cylinder block 110 via an outlet gallery 325 connected to the outlet port 125.

The coolant flow is a double pass cooling path across the cylinder head 110 in two directions out from the inlet port 120 near the first side of the cylinder head 110 to the opposite second side of the cylinder head 110 and back to the outlet port 125 near the first side of the cylinder head 110 and on two planes from a lower level where it enters the cylinder head 110 adjacent to the lower coolant jacket flame plate near the first side of the cylinder head 110 to an upper level requiring less cooling effect before exiting the cylinder block 110.

Therefore in summary, the use of an integrated coolant connector design enables improved coolant flow entry and exit and the location of the inlet improves the coolant flow into a lower coolant jacket flame plate area that is critical in order to maintain acceptable metal temperatures.

The integrated design also permits the sealing to be in a single location in one plane only, making sealing simpler and allowing for the sealing for both inlet & outlet to be together on the same surface.

During manufacture casting cores used to manufacture the cooling jacket are able to utilise core extensions of the cores used to produce the inlet and outlet as good supports and give much improved access for sand removal in that area.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another.

As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be appreciated by those skilled in the art that although the disclosure has been described by way of example with reference to one or more embodiments it is not limited to the disclosed embodiments and that alternative embodiments could be constructed without departing from the scope of the disclosure as defined by the appended claims.

The invention claimed is:

1. A cylinder head of an engine having a coolant jacket formed therein for circulating coolant through the cylinder head and a combined inlet and outlet connector formed as an integral part of the cylinder head for connecting the cylinder head to an external coolant system, the combined inlet and outlet connector comprising a flat planar surface defining, in a spaced apart manner, coolant inlet and outlet ports with the inlet port being positioned vertically below the outlet port, wherein a lower surface of the cylinder head is formed by a flame plate of the coolant jacket, and internal supply passages connected to the inlet port are positioned adjacent the flame plate so as to flow coolant over the flame plate, wherein the cylinder head has an exhaust gas manifold formed as an integral part thereof, the exhaust gas manifold exiting at a side of the cylinder head via an exhaust system mount having a flat exterior planar surface, the flat planar surface of the combined inlet and outlet connector arranged perpendicular to the flat exterior planar surface of the exhaust system mount and at the side of the cylinder head.

2. The cylinder head as claimed in claim 1, wherein the inlet port is a cylindrical port formed in the flat planar surface of the combined inlet and outlet connector and the outlet port is a cylindrical port formed in the flat planar surface of the combined inlet and outlet connector, where the combined inlet and outlet connector has no other openings in between the inlet and outlet ports on the flat planar surface of the combined inlet and outlet connector.

3. The cylinder head as claimed in claim 1, wherein the coolant jacket includes a number of internal return passages for flowing coolant through the coolant jacket back to the outlet port.

4. The cylinder head as claimed in claim 3, wherein the internal supply passages are connected to the internal return passages so as to form a cooling circuit within the cylinder head.

5. The cylinder head as claimed in claim 4, wherein the inlet port is located near a lower face of the cylinder head and a first side of the cylinder head, and the outlet port is located near an upper surface of the cylinder head and the first side of the cylinder head, and the cooling circuit within the cylinder head flows coolant from the inlet port through the internal supply passages to a second opposite side of the cylinder head, upwardly and back across the cylinder head from the second side of the cylinder head through the internal return passages to the outlet port near the first side of the cylinder head.

6. The cylinder head as claimed in claim 5, wherein the cooling circuit within the cylinder head is a double-pass two-plane coolant circuit.

7. The cylinder head as claimed in claim 1, wherein the combined inlet and outlet connector is at a corner of the cylinder head, with the inlet and outlet ports vertically stacked.

8. The cylinder head as claimed in claim 1, wherein the flat planar surface of the combined inlet and outlet connector is produced by machining an outer face of the cylinder head.

9. The cylinder head as claimed in claim 1, wherein the inlet port is produced by a casting and finish machining process.

10. The cylinder head as claimed in claim 1, wherein the outlet port is produced by a casting and finish machining process.

11. An engine having a cylinder block to which is sealingly secured to a cylinder head, wherein the cylinder head has a coolant jacket formed therein for circulating coolant through the cylinder head, and a combined inlet and outlet connector formed as an integral part of the cylinder head for connecting the cylinder head to an external coolant system, the combined inlet and outlet connector comprising a flat planar surface defining, in a spaced apart manner, coolant inlet and outlet ports with the inlet port being positioned immediately vertically below the outlet port, wherein a lower surface of the cylinder head is formed by a flame plate of the coolant jacket, and internal supply passages connected to the inlet port are positioned adjacent the flame plate so as to flow coolant over the flame plate, wherein the cylinder head has an exhaust gas manifold formed as an integral part thereof, the exhaust gas manifold exiting at a side of the cylinder head via an exterior planar surface of an exhaust system mount, the flat planar surface of the combined inlet and outlet connector arranged perpendicular to the exterior planar surface of the exhaust system mount and at the side of the cylinder head.

12. The engine as claimed in claim 11, wherein the inlet port is a cylindrical port formed in the flat planar surface of the combined inlet and outlet connector and the outlet port is a cylindrical port formed in the flat planar surface of the combined inlet and outlet connector.

13. The engine as claimed in claim 11, wherein the coolant jacket includes a number of internal return passages for flowing coolant through the coolant jacket back to the outlet port, and wherein the internal supply passages are connected to the internal return passages so as to form a cooling circuit within the cylinder head.

14. The engine as claimed in claim 13, wherein the inlet port is located near a lower face of the cylinder head and a first side of the cylinder head, and the outlet port is located near an upper surface of the cylinder head and the first side of the cylinder head, and the cooling circuit within the cylinder head flows coolant from the inlet port through the internal supply passages to a second opposite side of the cylinder head, upwardly and back across the cylinder head from the second side of the cylinder head through the internal return passages to the outlet port near the first side of the cylinder head.

15. The engine as claimed in claim 11, wherein the combined inlet and outlet connector has no other openings in between the inlet and outlet ports on the flat planar surface of the combined inlet and outlet connector.

16. The engine as claimed in claim 15, wherein the inlet port is produced by a casting and finish machining process.

17. The engine as claimed in claim 15, wherein the outlet port is produced by a casting and finish machining process.

18. An article, comprising: an engine cylinder head with a coolant jacket and a combined inlet and outlet connector integrally formed with the head connecting the head to an external-to-the-engine coolant system, the connector having a flat planar surface defining a coolant inlet immediately vertically below an outlet port, a lower surface of the head formed by a coolant jacket flame plate, internal supply passages connected to an inlet port being positioned adjacent the flame plate, wherein the head has an exhaust gas manifold formed as an integral part thereof, the exhaust gas manifold exiting at a side of the head via an exhaust system mount having a flat surface, a flat surface of the connector arranged perpendicular to the flat surface of the exhaust system mount, and the connector positioned at a corner of the side of the head.

19. The article of claim 18, wherein the vertical orientation is relative to gravity when a vehicle including an engine is positioned on level ground.

* * * * *